US006675441B2

(12) United States Patent
Breuer

(10) Patent No.: US 6,675,441 B2
(45) Date of Patent: Jan. 13, 2004

(54) DEVICE AND METHOD FOR DETECTING LIGHTWEIGHT WASTE IN A CARDING MACHINE

(75) Inventor: Achim Breuer, Aachen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/157,235

(22) Filed: May 30, 2002

(65) Prior Publication Data

US 2002/0152584 A1 Oct. 24, 2002

Related U.S. Application Data

(63) Continuation of application No. 10/076,111, filed on Feb. 15, 2002.

(30) Foreign Application Priority Data

Feb. 16, 2001 (DE) ..... 101 07 282

(51) Int. Cl.[7] ..... D01G 15/00
(52) U.S. Cl. ..... 19/98; 19/107; 19/109
(58) Field of Search ..... 19/98, 99, 102, 19/104, 105, 106 R, 107, 108, 110, 111, 112, 113, 114; 57/408

(56) References Cited

U.S. PATENT DOCUMENTS 4,057,877 A * 11/1977 Gunter ..... 19/107
4,064,598 A * 12/1977 Katoh et al. ..... 19/105
4,527,307 A * 7/1985 Teichmann ..... 19/105
4,700,431 A 10/1987 Artzt et al.
4,805,268 A * 2/1989 Leifeld ..... 19/105
5,692,267 A * 12/1997 Leifeld ..... 19/106 R
5,918,349 A 7/1999 Leifeld et al.
5,926,919 A 7/1999 Varga
5,930,869 A * 8/1999 Faas et al. ..... 19/98
5,974,629 A * 11/1999 Leifeld et al. ..... 19/98
6,085,390 A * 7/2000 Leifeld ..... 19/113

FOREIGN PATENT DOCUMENTS

| | | |
|---|---|---|
| DE | 26 48 715 | 5/1978 |
| DE | 33 46 335 | 7/1985 |
| DE | 34 29 024 | 2/1986 |
| DE | 36 29 559 | 3/1988 |
| DE | 196 51 893 | 6/1998 |
| DE | 198 31 139 | 1/2000 |

* cited by examiner

*Primary Examiner*—Gary L. Welch
(74) *Attorney, Agent, or Firm*—Venable LLP; Robert Kinberg; Stuart Smith

(57) ABSTRACT

A carding machine includes clothed rolls for processing and carrying fiber material thereon; an arrangement for separating lightweight waste from the fiber material processed by the clothed rolls; a conduit for receiving the lightweight waste; an air stream generating arrangement for generating an air flow in the conduit for removing the lightweight waste; an adjusting device for varying a degree of carding intensity of the carding machine; and a detecting device for measuring quantities of the lightweight waste produced at a respective degree of carding intensity.

10 Claims, 4 Drawing Sheets

DEVICE AND METHOD FOR DETECTING LIGHTWEIGHT WASTE IN A CARDING MACHINE

CROSS REFERENCE TO RELATED APPLICATIONS

This application is a continuation of application Ser. No. 10/076,111 filed Feb. 15, 2002.

This application claims the priority of German Application No. 101 07 282.1 filed Feb. 16, 2001, which is incorporated herein by reference.

BACKGROUND OF THE INVENTION

This invention relates to a device and method for detecting lightweight waste such as short fibers, dust, fiber fragments, fly and the like in a carding machine. Such waste is released from the fiber material while being processed by a clothed fiber processing roll. The waste is carried away in a suction conduit containing a filter.

In a known apparatus, such as disclosed, for example, in German Patent No. 34 29 024 the dust and dirt content of the fiber material is measured. The fiber material is advanced by a feeding device to an opening roll which cooperates with a dust separating opening provided with a sieve-like surface adjoined by a filtering unit which, as viewed in the direction of the flow of the suction stream, comprises a sieve for short fibers and fly and a dust filter. After performing a test, the proportion of dust (at the dust filter) and short fibers (at the sieve) may be determined by measurements. It is a disadvantage of such a prior art arrangement that the degree of the intensity of fiber opening performed by the opening roll remains unchanged. It is a further drawback that the measuring and evaluating steps are intermittent which is a structurally complex solution.

SUMMARY OF THE INVENTION

It is an object of the invention to provide an improved device and method of the above-outlined type from which the discussed disadvantages are eliminated and which, in particular, make possible a continuous determination of the fiber damages as a result of the degree of aggressiveness of the carding operation.

This object and others to become apparent as the specification progresses, are accomplished by the invention, according to which, briefly stated, the carding machine includes clothed rolls for processing and carrying fiber material thereon; an arrangement for separating lightweight waste from the fiber material processed by the clothed rolls; a conduit for receiving the lightweight waste; an air stream generating arrangement for generating an air flow in the conduit for removing the lightweight waste; an adjusting device for varying a degree of carding intensity of the carding machine; and a detecting device for measuring quantities of the lightweight waste produced at a respective degree of carding intensity.

By virtue of the invention, the degree of fiber damage to the carded fiber material (aggressiveness of carding) can be continuously (on-line) determined. It is a particular advantage of the invention that the degree of fiber damage in a given carding operation, as concerns the quantity of light waste, may be compared with measured values for the damaged fiber in case of gentle carding and in case of aggressive carding and to derive an optimal setting for the carding process from these findings.

DESCRIPTION OF THE PREFERRED EMBODIMENTS

Figure 1:
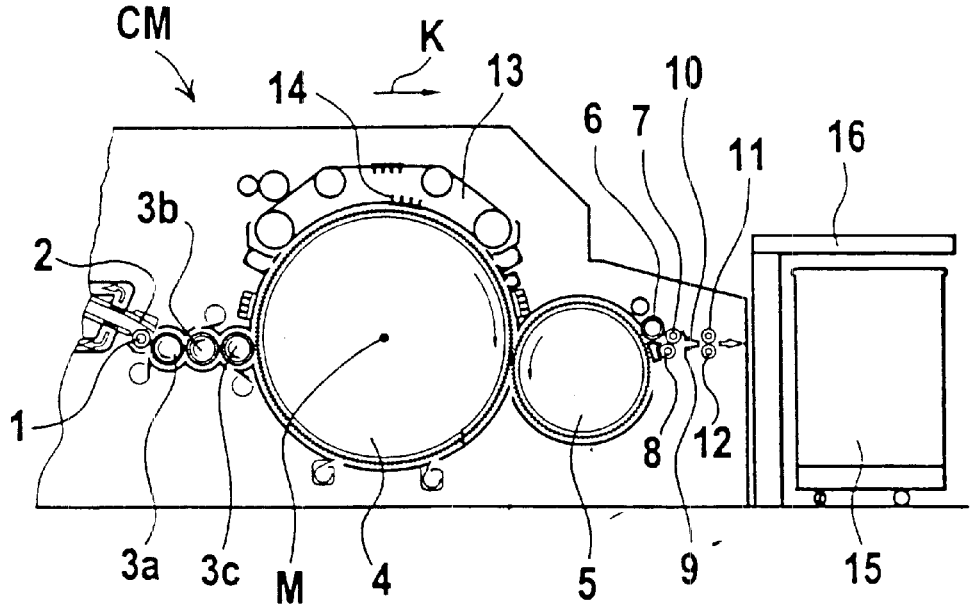
FIG. 1 is a schematic side elevational view of a carding machine incorporating the invention.

FIG. 1 shows a carding machine CM which may be a high-performance DK 903 model manufactured by Tr ützschler GmbH & Co. KG, Mönchengladbach, Germany. The carding machine CM has a feed roller 1, a feed table 2 cooperating with the feed roller 1, licker-ins 3*a*, 3*b*, 3*c*, a main carding cylinder 4 having a rotary axis M, a doffer 5, a stripping roll 6, crushing rolls 7, 8, a web guiding element 9, a sliver trumpet 10, calender rolls 11, 12, a traveling flats assembly 13 having flat bars 14, a sliver coiler 16 depositing sliver into a coiler can 15. The processing direction of the fiber material through the carding machine CM is designated with the arrow K.

Figure 2:
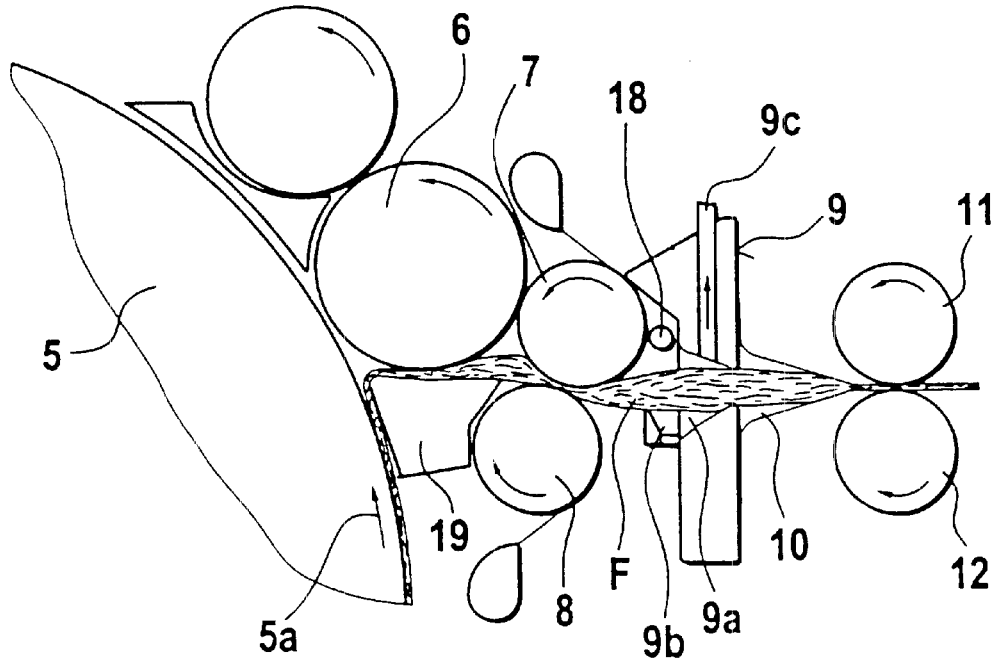
FIG. 2 is a schematic side elevational view of the sliver output region of the carding machine showing suction devices for removing lightweight fiber waste.

FIG. 2 shows a web guiding element 9 which may be, for example, a WEBSPEED model manufactured by Tr ützschler GmbH & Co. KG. The web guiding element 9 has an advance trumpet 9*a* preceded by a web-supporting element 9*b*, as viewed in the direction of material advance. Between the advance trumpet 9*a* and the sliver trumpet 10 an air gap is present through which lightweight fiber waste exits and is removed by suction via a suction conduit 9*c*. The fiber material F is taken off the doffer 5 by the stripping roll 6 and is introduced via a web-supporting and guiding element 19 into the nip defined between the cooperating crushing rolls 7, 8. The fiber material exiting the crushing rolls 7, 8 is backed up by the supporting element 9*b* and introduced in the inlet opening of the advance trumpet 9*a*. The fiber material then passes through the advance trumpet 9*a* and the sliver trumpet 10 and is withdrawn therefrom by calender rolls 11, 12 as a fiber sliver. In the region above the fiber material F, between the nip defined by the crushing rolls 7, 8 and the inlet of the advance trumpet 9*a* a further suction conduit 18 is provided for removing the lightweight fiber material.

Figure 3A:
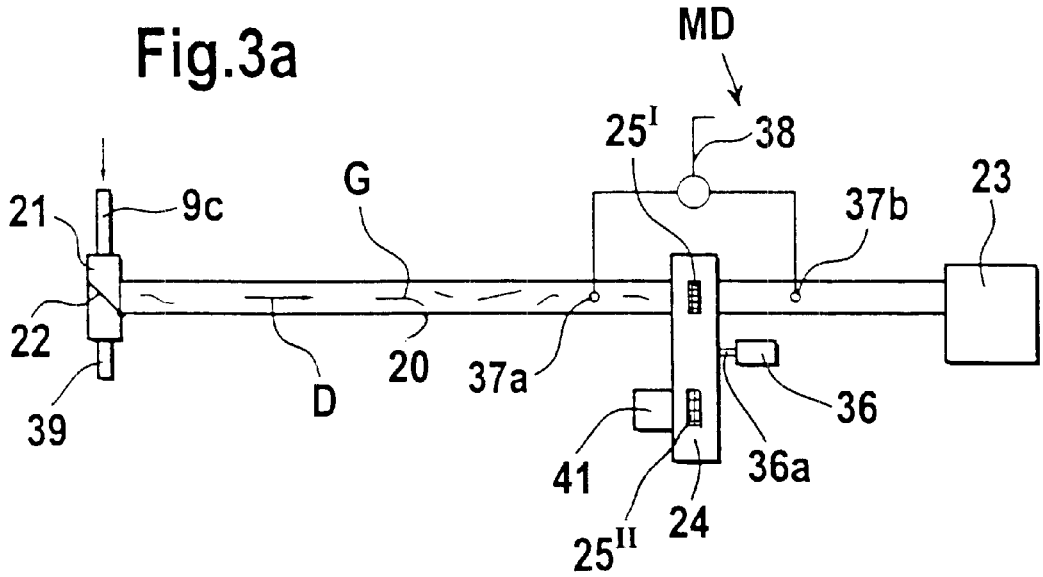
FIG. 3*a* is a schematic side elevational view of a measuring device for lightweight fiber waste.
Figure 3B:
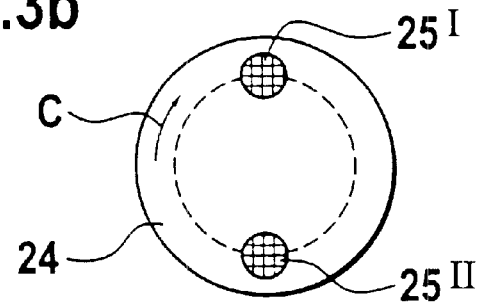
FIG. 3*b* is a schematic end elevational detail of the construction shown in FIG. 3*a*.

Turning to FIGS. 3*a* and 3*b*, the lightweight waste-carrying conduit 9*c* has a branch conduit 20 for carrying the lightweight waste G in the direction D. In the conduit 20 a measuring device MD is disposed. In the upstream branching location of the conduit 20 a switch 21 is provided which includes a pivotal gate 22 for selectively directing the waste material from the conduit 9*c* either into the conduit 20 or into the conduit 39 which bypasses the measuring device MD and which is connected to a filter device of the carding machine. The downstream end of the conduit 20 is connected to a suction source such as a fan 23.

The measuring device MD comprises a filter assembly having a filter carrier disk 24 traversing the conduit 20 and rotated by a motor 36 about an axis 36*a* extending parallel to the longitudinal axis of the conduit 20. The filter assembly further has two filter elements $\mathbf{25}^{I}$ and $\mathbf{25}^{II}$ which are pervious to the air stream generated by the suction source 23 but which retain thereon the fiber waste G. The filter elements $\mathbf{25}^{I}$ and $\mathbf{25}^{II}$ are mounted in a diametrically opposite relationship on the carrier disk 24. Also referring to FIG. 3*b*, when the active, waste-laden filter element $\mathbf{25}^{I}$ is to be replaced, the disk 24 is rotated in the direction of the arrow C. As a result, the filter element $\mathbf{25}^{I}$ is moved from its operative position depicted in FIG. 3*a* into a cleaning position which is externally of the conduit 20 and which is in alignment with a cleaning device 41, such as a suction arrangement. At the same time, the filter element $\mathbf{25}^{II}$ previously purged of the waste by the cleaning device 41, is moved into the operative position in the path of the stream flowing in the conduit 20.

Inside the conduit 20, upstream and downstream of the filter disk 24, respective pressure sensors 37*a* and 37*b* are disposed. A differential pressure measuring device 38 generates a signal which represents the difference between the pressures measured by the sensors 37*a*, 37*b* upstream and downstream of the filter disk 24. The differential pressure measuring device 38 is connected to an electronic control and regulating device 33 (FIG. 6) which has a memory for receiving data relating to the function between the differential pressures and the quantity of the lightweight fiber waste G adhering to the filter 25. At a given nominal pressure difference, the motor 36 rotates the filter disk 24 to thus move the filter $\mathbf{25}^{I}$ into alignment with the cleaning device 41. A rotation of the filter disk 24 can also be initiated after a predetermined delay.

Figure 3C:
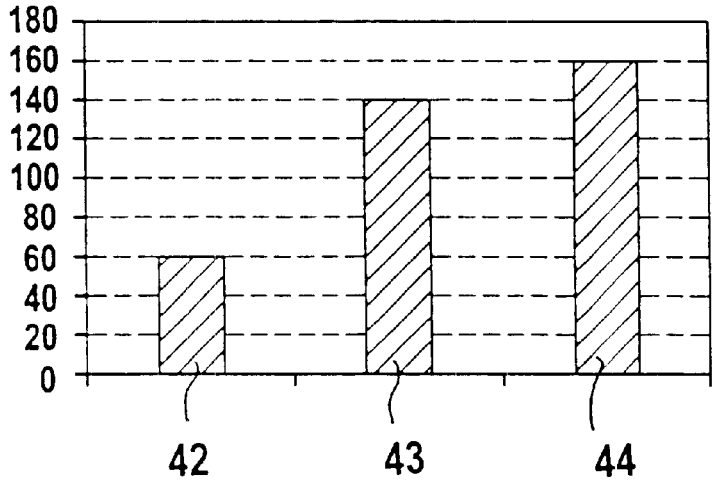
FIG. 3*c* is a diagram showing the dependency of differential pressures from the setting of the carding degree.

FIG. 3*c* illustrates the above-described differential pressures measured in Pa units for an empty filter, represented by bar 42, a waste-laden filter at a gentle carding, represented by bar 43 and a waste-laden filter at an aggressive carding, represented by bar 44.

Figure 4A:
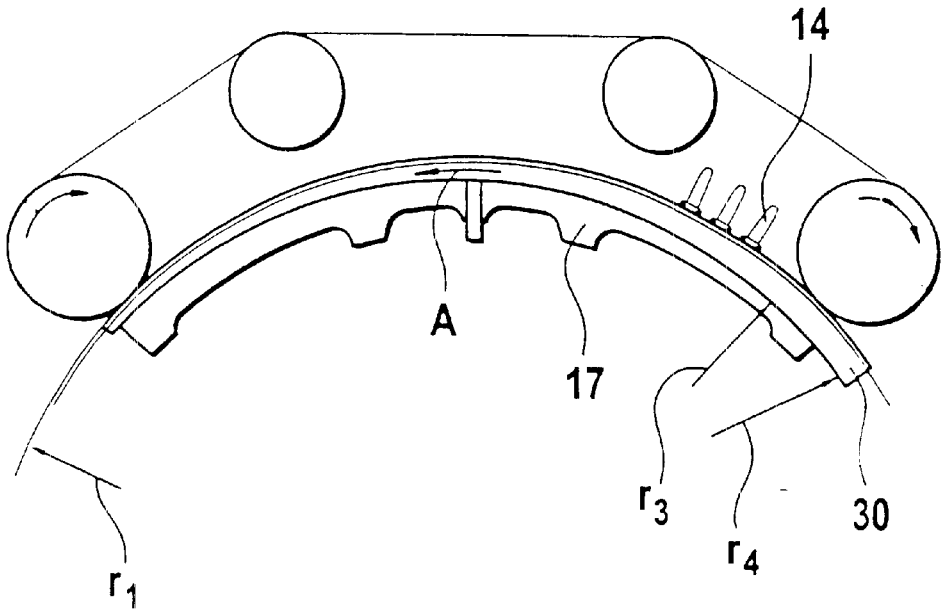
FIG. 4*a* is a schematic side elevational view of traveling flats of a carding machine showing a circumferentially shiftable slide guide in a first position.
Figure 4B:
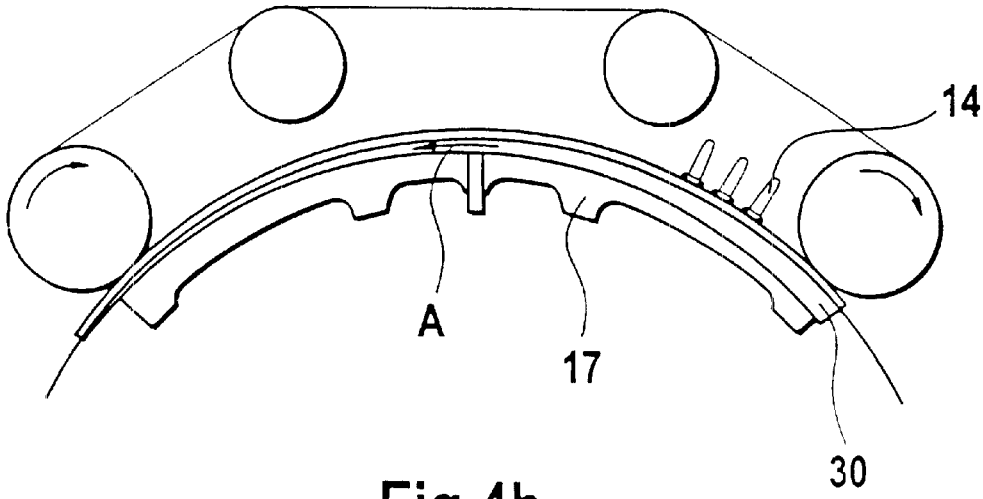
FIG. 4*b* is a view similar to FIG. 4*a* showing the slide guide in a second position.

FIGS. 4*a* and 4*b* show a device for adjusting the carding clearance between the clothings of the flat bars 14, on the one hand, and the clothing of the carding cylinder 4, on the other hand. The extent of such a clearance determines the degree of carding intensity. The adjusting device of FIGS. 4*a* and 4*b* comprises a slide guide 30 which is slightly wedge-shaped as viewed in the circumferential direction. As related to the cylinder axis M (shown in FIG. 1 but not shown in FIGS. 4*a* and 4*b*), the slide guide 30 has an outer surface which, when viewed circumferentially, is throughout concentric with the cylinder axis M, that is, its radius $r_1$ is constant. The underside of the slide guide 30 has, as viewed in the circumferential direction A, a changing radius $r_4$. The slide guide 30 is shiftable on an arcuate supporting surface of a flexible bend 17. The supporting surface of the flexible bend 17 has a circumferentially changing radius $r_3$. As a result of a circumferential displacement of the slide guide 30, the radius $r_1$ of the slide guide surface changes, whereupon the flat bars 14 which glide on the slide surface of the slide guide 30 change their distance from the cylinder 4, thus changing the degree of carding intensity. It is seen that the position of the slide guide 30 depicted in FIG. 4*b* has been shifted in the direction of the arrow A with respect to the position shown in FIG. 4*a*.

Figure 5:
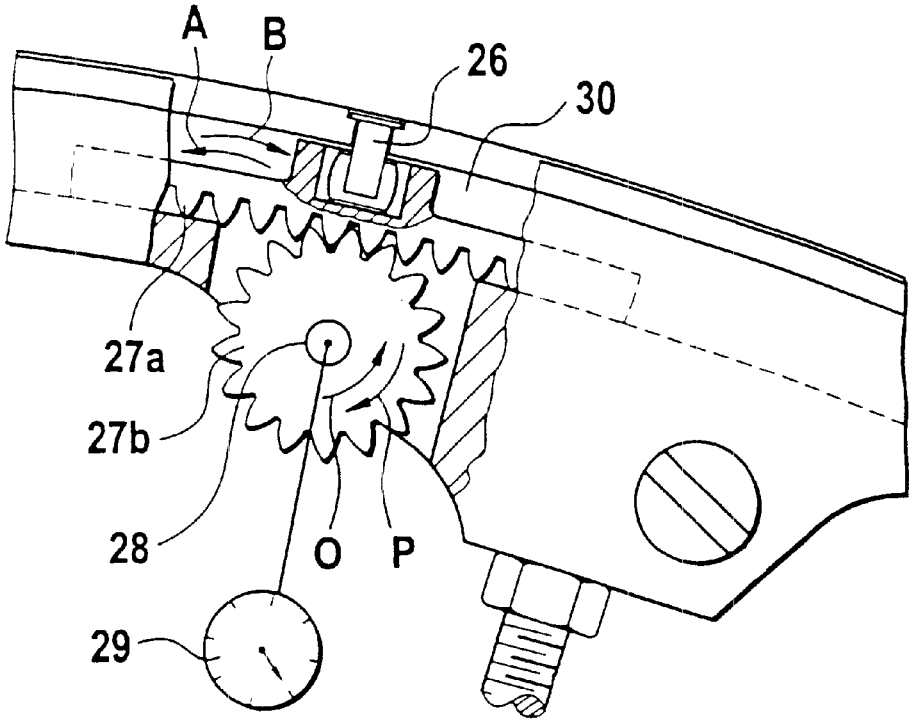
FIG. 5 is a schematic side elevational view of a device for circumferentially shifting a slide guide.

Turning to FIG. 5, on the slide guide 30 a carrier element 26 is arranged which is coupled with a toothed rack 27*a*. The latter, in turn, meshes with a gear 27*b* which is rotatable in the direction O, P. The gear 27*b* is driven by a reversible motor 28, whereby the slide guide 30 is shiftable circumferentially in the direction of the arrows A, B. The motor 28 is connected with an inputting device 29 with which a very small carding clearance, for example, 3/1000 inch may be set as a nominal value. The setting of the carding clearance may also be effected by an electronic control and regulating device 33 (FIG. 6) with a nominal value memory and/or inputting device. The above-described adjustment of the radius of a slide surface of a slide guide by circumferentially shifting the slide guide is described in further detail in U.S. Pat. No. 5,918,349.

When a small carding clearance is set by the mechanism shown in FIGS. 4*a*, 4*b* and 5, a more aggressive carding results with an increased proportion in lightweight fiber waste G. Conversely, in case the carding clearance is enlarged (such a position is illustrated in FIG. 4*b*), a less aggressive, gentle carding results with a smaller proportion of lightweight fiber waste G. As illustrated in FIG. 3*c*, a relationship exists between the extent of charging the filter 25 with lightweight fiber waste G and the carding process based on the setting of the carding clearance.

Figure 6:
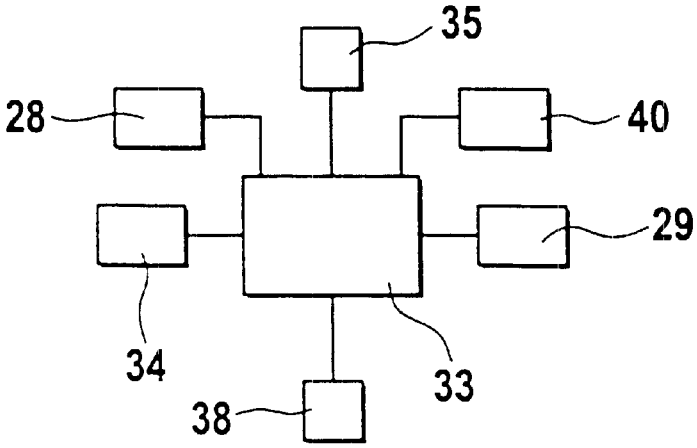
FIG. 6 is block diagram of an electronic control and regulating device.

FIG. 6 shows a block diagram of an electronic control system which has a control and regulating device 33, for example, a microcomputer, connected to an inputting device 34 for the desired carding clearance, the drive motor 28, a display device 40, a further inputting device 29, a switch 35 for the motor 36 and the differential pressure measuring device 38.

In the description which follows, short fiber content, dust and fiber fragments, that is, lightweight fiber waste, are hereafter collectively designated as KSF. During the carding process, the difference between the fiber sparing (gentle) carding and the aggressive (more damaging) carding manifests itself particularly in the changed short fiber fly proportion, the degree of exiting dust and the extent of fiber fragments released to the environment when the sliver is mechanically stressed (release of KSF parts). The released KSF parts which form only one part of the totality of KSF parts in the sliver, are proportionate to the KSF parts remaining in the material (assuming a constant room and material climate). By virtue of the fact that according to the invention the released KSF quantities are captured by vacuum means, it is feasible to describe the degree of fiber damaging, that is, the degree carding.

The mechanical stress on the fiber material (sliver) appears after the carding process in the region of doffing. In this connection particularly two locations are of importance, namely, the position above the web guiding element 9 and the position above the advance trumpet 9*a* preceding the trumpet 10. A meaningful reference magnitude is obtained by relating everything to the KSF quantity which is released in case of a non-aggressive (gentle) carding. If it is desired to additionally describe the entire carding range by means of KFS quantities, then the KFS quantities for an extremely aggressive (damaging) card setting are also detected. For changing the carding intensity the carding clearance is automatically adjusted as explained earlier in connection with FIGS. 4*a*, 4*b* and 5.

First, the KFS quantity is deliberately removed by suction and directed to the active filter $\mathbf{25}^{I}$ or $\mathbf{25}^{II}$ of the measuring device MD. After a defined time period the pressure at locations upstream and downstream of the active filter is determined from which the pressure difference AP is obtained. Such a pressure difference is proportional to the KFS quantity. If the pressure difference in case of non-aggressive carding is set to 0%, the degree of the aggressiveness of all other carding processes may be expressed in percentage with which the degree of carding may be described on-line.

Measuring of the KFS quantity may be effected by a portable measuring device at different locations of the carding machine. Assuming the presence of a carding clearance setting system as described in connection with FIGS. 4*a*, 4*b* and 5, it is feasible to integrate the KFS quantity determining system into the carding machine. In such a case cleaning of the filter may be effected by reversing the airflow by virtue of reversing the direction of operation of the fan 23.

It will be understood that the above description of the present invention is susceptible to various modifications, changes and adaptations, and the same are intended to be comprehended within the meaning and range of equivalents of the appended claims.

What is claimed is:

1. A carding machine comprising:

(a) clothed rolls for processing and carrying fiber material thereon;

(b) means for separating lightweight waste from the fiber material processed by the clothed rolls;

(c) a conduit for receiving the lightweight waste;

(d) air stream generating means for generating an air flow in said conduit for removing the lightweight waste;

(e) adjusting means for varying a degree of carding intensity of said carding machine;

(f) detecting means for measuring quantities of the lightweight waste produced at a respective degree of carding intensity;

(g) a carding machine outlet, said conduit extending from said carding machine outlet; and (h) a pair of crushing rolls and a sliver trumpet through which the fiber material consecutively passes, said conduit extending from between said crushing rolls and said sliver trumpet.

2. The carding machine as defined in claim 1, wherein said detecting means comprises (a) a filter disposed in said conduit for retaining thereon the lightweight waste carried by the air flow;

(b) first and second pressure sensors disposed in said conduit upstream and downstream of said filter as viewed in the direction of the air flow; and (c) a pressure difference forming device connected to said first and second pressure sensors for determining a difference between pressures detected by said first and second pressure sensors.

3. A carding machine comprising:

(a) clothed rolls for processing and carrying fiber material thereon;

(b) means for separating lightweight waste from the fiber material processed by the clothed rolls;

(c) a conduit for receiving the lightweight waste;

(d) air stream generating means for generating an air flow in said conduit for removing the lightweight waste;

(e) adjusting means for varying a degree of carding intensity of said carding machine; and (f) detecting means for measuring quantities of the lightweight waste produced at a respective degree of carding intensity, wherein said conduit comprises a first branch conduit and a second branch conduit, said first branch conduit containing said detecting means, said second branch conduit extending from said first branch conduit for bypassing said detecting means, and a gate for selectively directing the lightweight waste into said first branch conduit and said second branch conduit.

4. A carding machine comprising:

(a) clothed rolls for processing and carrying fiber material thereon;

(b) means for separating lightweight waste from the fiber material processed by the clothed rolls;

(c) a conduit for receiving the lightweight waste;

(d) air stream generating means for generating an air flow in said conduit for removing the lightweight waste;

(e) adjusting means for varying a degree of carding intensity of said carding machine;

(f) detecting means for measuring quantities of the lightweight waste produced at a respective degree of carding intensity, said detecting means comprising a filter disposed in said conduit for retaining thereon the lightweight waste carried by the air flow;

first and second pressure sensors disposed in said conduit upstream and downstream of said filter as viewed in the direction of the air flow; and a pressure difference forming device connected to said first and second pressure sensors for determining a difference between pressures detected by said first and second pressure sensors;

(g) a movably supported carrier disk having a first portion disposed in said conduit and a second portion disposed externally of said conduit;

(h) first and second filter elements, constituting said filter, mounted on said disk eccentrically thereof; and (i) means for moving said disk for periodically and alternatingly placing said first and second filter elements in said conduit and externally thereof.

5. The carding machine as defined in claim 4, further comprising a filter cleaning device for removing waste from the filter element dwelling externally of said conduit.

6. A carding machine comprising:

(a) clothed rolls for processing and carrying fiber material thereon;

(b) means for separating lightweight waste from the fiber material processed by the clothed rolls;

(c) a conduit for receiving the lightweight waste;

(d) air stream generating means for generating an air flow in said conduit for removing the lightweight waste;

(e) adjusting means for varying a degree of carding intensity of said carding machine;

(f) detecting means for measuring quantities of the lightweight waste produced at a respective degree of carding intensity, said detecting means comprising a filter disposed in said conduit for retaining thereon the lightweight waste carried by the air flow;

first and second pressure sensors disposed in said conduit upstream and downstream of said filter as viewed in the direction of the air flow; and a pressure difference forming device connected to said first and second pressure sensors for determining a difference between pressures detected by said first and second pressure sensors; and (g) control means for setting the degree of carding intensity as a function of the pressure difference.

7. The carding machine as defined in claim 6, wherein said control means comprises an electronic control and regulating device connected to said pressure difference forming device for receiving signals therefrom representing the pressure difference.

8. The carding machine as defined in claim 7, wherein said adjusting means is connected to said electronic control and regulating device.

9. A method of measuring lightweight waste in a carding machine, comprising the following steps:

(a) processing fiber material by clothed rolls;

(b) separating lightweight waste from the fiber material processed by the clothed rolls;

(c) introducing the lightweight waste in a conduit;

(d) generating an air flow in said conduit for carrying the lightweight waste;

(e) varying a degree of carding intensity of said carding machine for setting a degree of gentle carding and a degree of aggressive carding;

(f) measuring quantities of the lightweight waste produced at a degree of gentle carding;

(g) generating first signals representing measured quantities of the lightweight waste produced at a degree of gentle carding;

(h) measuring quantities of the lightweight waste produced at a degree of aggressive carding;

(i) generating second signals representing measured quantities of the lightweight waste produced at a degree of aggressive carding; and (j) comparing said first and said second signals with one another.

10. The method as defined in claim 9, wherein the measuring steps (f) and (h) each comprise the following steps:

(a) positioning a filter in said conduit for retaining thereon the lightweight waste carried by the air flow;

(b) sensing a pressure in said conduit upstream and downstream of said filter as viewed in the direction of the air flow;

(c) generating third and fourth signals representing, respectively, sensed pressures in said conduit upstream and downstream of said filter; and (d) generating a fifth signal representing a difference between pressures sensed upstream and downstream of said filter.

* * * * *